United States Patent [19]

Clissett

[11] 4,045,981

[45] Sept. 6, 1977

[54] PROCESS FOR BULKING KNITTED FABRIC ARTICLES

[75] Inventor: Dennis Edward Clissett, Harrogate, England

[73] Assignee: Imperial Chemical Industries Limited, London, England

[21] Appl. No.: 709,261

[22] Filed: July 27, 1976

Related U.S. Application Data

[63] Continuation of Ser. No. 510,140, Sept. 27, 1974, abandoned.

[51] Int. Cl.[2] ..... D04B 15/92; D06C 5/24

[52] U.S. Cl. ..... 66/147; 28/154

[58] Field of Search ..... 28/72 FT, 74 H, 154; 34/10, 225; 66/147, 178 A, 149 S; 68/5 C, 6

[56] References Cited

U.S. PATENT DOCUMENTS

| | | | |
|---|---|---|---|
| 151,838 | 6/1874 | Calkins | 68/6 |
| 1,434,193 | 10/1922 | Braley | 34/10 X |
| 1,652,276 | 12/1927 | Gregg | 34/10 X |
| 1,671,442 | 5/1928 | Noftzger | 34/10 X |
| 2,050,626 | 8/1936 | Otis | 34/10 X |
| 2,350,021 | 5/1944 | Dunn | 68/6 X |
| 2,679,739 | 6/1954 | Brooks | 66/178 A UX |
| 2,848,146 | 8/1958 | Kronsbein | 68/5 C X |
| 3,021,588 | 2/1962 | Bolinger et al. | 28/72 FT X |
| 3,125,848 | 3/1964 | Baebler | 66/178 A X |
| 3,271,837 | 9/1966 | Aw et al. | 28/74 H |
| 3,330,451 | 7/1967 | Gordon | 68/6 X |
| 3,358,387 | 12/1967 | Eckardt et al. | 34/225 |
| 3,499,196 | 3/1970 | Matthews et al. | 28/74 H |
| 3,686,726 | 8/1972 | Glaze, Jr. et al. | 28/74 H |
| 3,906,750 | 9/1975 | Rowth et al. | 66/147 |

*Primary Examiner*—Robert R. Mackey

*Attorney, Agent, or Firm*—Cushman, Darby & Cushman

[57] ABSTRACT

Method for developing potential yarn bulk in knitted fabric by introducing the fabric into a turbulent flow of heated air.

8 Claims, 2 Drawing Figures

PROCESS FOR BULKING KNITTED FABRIC ARTICLES

Figure 2:
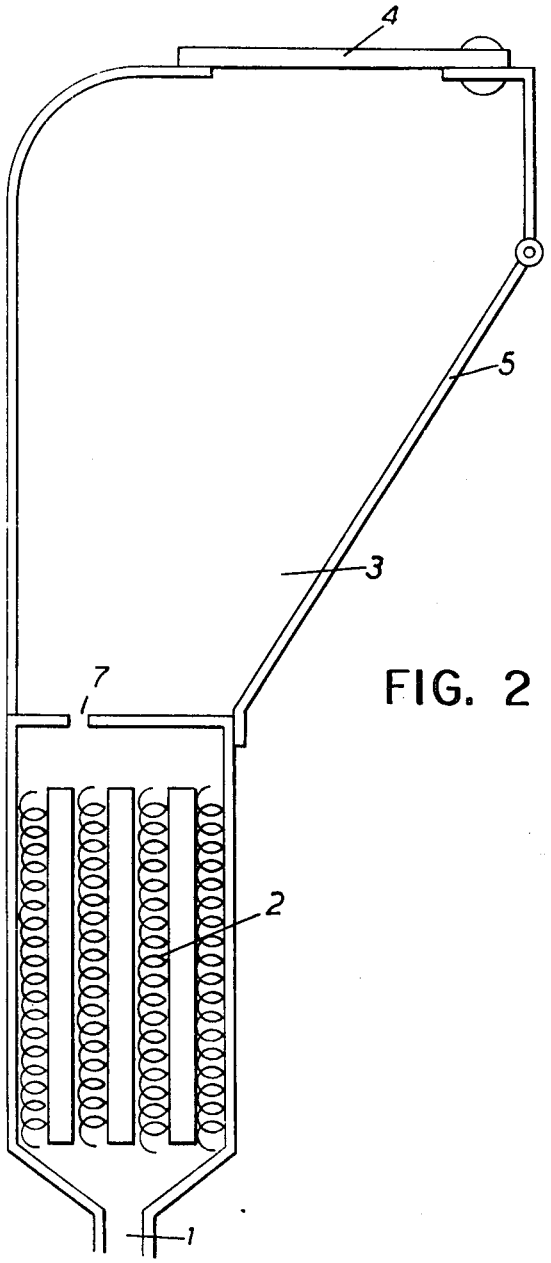

This is a continuation of application Ser. No. 510,140 filed Sep. 27, 1974, now abandoned.

This invention relates to yarn bulk development in knitted fabrics and particularly but not exclusively, to knitted garments such as pantihose.

Normally, hose knitted from bulked yarn or yarn with latent bulk is scoured and dyed and the bulk developed during these wet processes. In the present invention we have found that by agitating a knitted garment with potential yarn bulk in a turbulent flow of heated air, the bulk can be developed rapidly and fully and in a time compatible with the throughput of the knitting machine. Thus if a one-piece garment comprises yarns possessing potential bulk then an automatic integrated process is possible from knitting to bulk development, for example, in the case of hose legs or one-piece pantihose.

Accordingly, the present invention provides a process for developing potential yarn bulk in a knitted fabric in which the fabric is introduced into a turbulent flow of heated air where it is agitated by the turbulence for a time sufficient to develop the required bulk.

Preferably the fabric comprises pre-coloured yarns (spun coloured or dyed) so that the dyeing step where bulk is usually developed may be completely eliminated.

When undyed yarn is used the knitted fabric is dyed after bulk development according to the invention, in which case dyeing may also be accompanied by additional bulking.

An important advantage of the present invention is that following bulk development the knitted fabric has a flat, crease-free appearance requiring, in most cases, no conventional finishing. Thus for one-piece garments comprising pre-coloured yarns, this means the garment may be packaged immediately after bulk development, i.e. in an integrated process, e.g. one-piece pantihose.

Apparatus suitable for effecting the process of the invention comprises a chamber in which the fabric may be agitated in a flow of turbulent air heated to a required temperature, the chamber having at least one door for introducing and ejecting the fabric and which may be operated automatically to match the throughput of a knitting machine.

Figure 1:
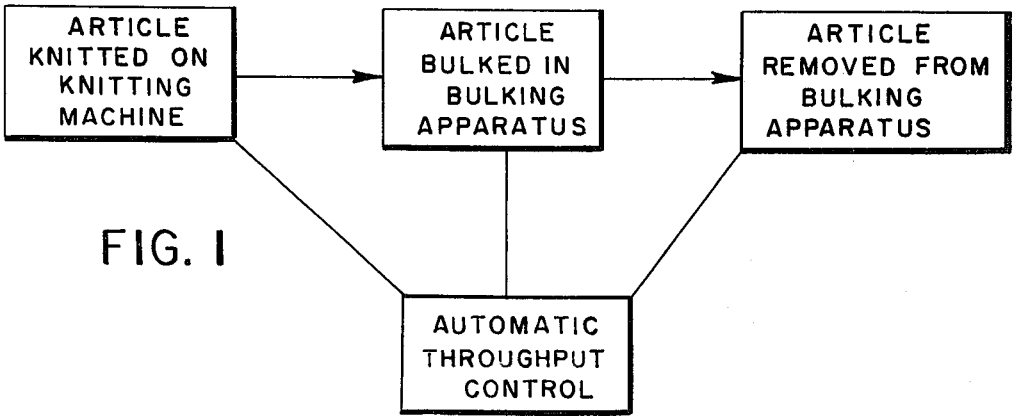

In the drawings:

FIG. 1 is a diagrammatic illustration of an automatic integrated process embodying the present invention; and FIG. 2 is a detailed sectional view of the bulking apparatus of FIG. 1.

The apparatus comprises an air inlet 1, an air heater 2, a chamber 3 and fabric inlet and outlet doors 4 and 5. In operation, an air blower (not shown) supplies air to inlet 1 and the heater 2 is controlled to provide a constant air temperature in chamber 3. The heated air jets into the chamber 3 through an orifice 7. Air may escape from chamber 3 via the inlet and outlet doors or alternatively may be recycled or piped via a vent in the chamber (not shown) away from the apparatus. A fabric discharged from a knitting machine is delivered to a position above door 4 and on opening door 4 it drops into chamber 3 in which the turbulent air flow from the heater 2 agitates and tumbles it. After a sufficient time to develop bulk, door 5 is opened and the fabric is ejected. The opening and closing of the doors may be automatic to match the rate of knitting and the time required for bulk development.

Normally a single knitting machine feeds a single chamber though in some instances more than one machine may be coupled to the same chamber.

The following examples are intended to illustrate but not limit the present invention.

EXAMPLE 1

A hose leg knitted from producer textured (false twist crimped) 22 decitex 6 filament yarn (panel portion) and 33 decitex 10 filament yarn (body portion) derived from polyhexamethylene adipamide was supported under zero tension and agitated in a partially closed, cylindrical, 3¼ inch diameter vertical tube 60 inches long, bu a turbulent upward flow of 400 liters/minute of air preheated to 140° C. Maximum fabric bulk development was achieved in 2.8 minutes. It was also found that 200 liters/minute of air was sufficient to support and agitate the hose.

EXAMPLE 2

In this Example a series of trials were carried out using apparatus similar to that described above and shown in the accompanying drawing. The chamber of the apparatus was 6 inches square at the top and tapered down over 8 inches to a 2 inch diameter circular base having a ⅛ inch diameter orifice. Air was supplied via a 1.8 kw rated heater.

In these trials hose legs were subjected for different time intervals to various air temperatures and flow rates in order to determine optimum treatment conditions. These conditions were considered to be those combinations of time, temperature and flow which resulted in a relaxed bulked hose length of 18 to 20 inches (measured from the sole side of the heel to the junction of the panel and the body).

The hose legs used in the trials were knitted (construction 3 × 1 micromesh) from the same producer textured yarns described in Example 1. A conventional hose stitch length was used and the legs were knitted to give a relaxed panel portion length of 40 inches, i.e. heel to body portion.

The results of the trials are shown in the Table below, from which it is clear that for hose legs of the kind used, optimum treatment conditions correspond substantially to those shown in the final section of the Table.

It is to be understood that the present invention is not limited to bulk development in knitted hose, but is also applicable to the development of bulk in any knitted fabric subject, of course, to the determination of optimum treatment conditions.

TABLE

| Air flow rate (cold) (liters/min.) | Temp. of air entering chamber (° C.) | Relaxed bulked hose length (inches) Time (minutes) 0.5 | 1.0 | 2.0 | Temp. of air entering chamber (° C.) | Relaxed bulked hose Length (inches) Time (minutes) 0.5 | 1.0 | 2.0 | Temp. of air entering chamber (° C.) | Relaxed bulked hose Length (inches) Time (minutes) 0.5 | 1.0 | 2.0 | Temp. of air entering chamber (° C.) | Relaxed bulked hose Length (inches) Time (minutes) 0.5 | 1.0 | 2.0 | Temp. of air entering chamber (° C.) | Relaxed bulked hose Length (inches) Time (minutes) 0.5 | 1.0 | 2.0 |
|---|---|---|---|---|---|---|---|---|---|---|---|---|---|---|---|---|---|---|---|---|
| 28 | 47 | 29 | 29½ | 33½ | 67 | 29½ | 32 | 29¾ | 89 | 24 | 23½ | 23¼ | 117 | 20 | 19¼ | 19 | 160 | 18½ | 18½ | 17½ |
| 57 | 44 | 30¾ | 31 | 30¾ | 62 | 31 | 28½ | 29¼ | 83 | 24¼ | 24¼ | 23¾ | 108 | 20¾ | 20¼ | 20¼ | 147 | 18 | 18¼ | 17¾ |
| 85 | 41 | 31¼ | 31¼ | 31½ | 57 | 31 | 30¾ | 30 | 77 | 24¼ | 25¼ | 26 | 99 | 22¾ | 22½ | 22 | 135 | 18½ | 18¼ | 18 |
| 115 | 38 | 31½ | 32 | 31¾ | 54 | 31 | 30½ | 31 | 71 | 26½ | 27¼ | 27¼ | 92 | 22 | 23¼ | 23½ | 120 | 19½ | 19¼ | 19 |
| 145 | 35 | 31¾ | 33 | 32 | 50 | 31¾ | 32 | 31 | 67 | 27¼ | 27¾ | 27¾ | 87 | 24¾ | 23¾ | 23¼ | 112 | 20½ | 21 | 20 |

What is claimed is:

1. A process for developing yarn bulk in a knitted fabric article comprising yarn having potential bulk which is compatible with the time required to knit the article, said process comprising agitating and tumbling the fabric article in a chamber, directly after knitting in an automatic integrated process therewith and before said article is subjected to any wet treatment, by a turbulent stream of upwardly flowing heated air introduced into the chamber so as to support the fabric therein and removing the fabric in crease-free condition from the chamber after a period of time sufficient to develop the bulk.

2. A process according to claim 1 in which the fabric comprises knitted one-piece pantyhose.

3. A process according to claim 1 in which the fabric comprises knitted hose legs.

4. A process according to claim 1 in which the fabric comprises yarn derived from a polyamide.

5. A process according to claim 4 in which the fabric comprises yarn derived from polyhexamethylene adipamide.

6. A process as in claim 1 wherein only a single knitted article at any one time is agitated and tumbled in the chamber.

7. A process as in claim 6 wherein the yarn in said knitted article is precolored yarn.

8. A process for developing yarn bulk in a knitted fabric article comprising yarn having potential bulk which is compatible with the time required to knit the article, said process comprising agitating and tumbling the fabric article in a chamber, directly after knitting in an automatic integrated process therewith and before said article is subjected to any wet treatment, by a turbulent stream of upwardly flowing heated air introduced into the chamber at a flow rate of 28–145 liters/minute and at a temperature of 112° C–160° C so as to support the fabric therein and removing the fabric in crease-free condition from the chamber after a treatment time of 0.5–2.0 minutes and sufficient to develop the bulk.

* * * * *